US005571039A

United States Patent [19]

Ford

[11] Patent Number: 5,571,039

[45] Date of Patent: Nov. 5, 1996

[54] ABDOMINAL SUPPORT

[76] Inventor: Donna M. Ford, 3409 West 42nd Avenue, Vancouver, British Columbia, Canada

[21] Appl. No.: 330,789

[22] Filed: Oct. 28, 1994

[51] Int. Cl.[6] ..... A41C 1/10; A41C 1/08

[52] U.S. Cl. ..... 450/155; 450/115; 450/116; 450/118; 450/122; 450/124; 450/130; 2/44; 2/45; 602/19

[58] Field of Search ..... 2/44, 45, 92; 450/117, 450/118, 120, 122, 123, 124, 125, 126, 130, 131, 146, 150, 114, 115, 116; 602/19

[56] References Cited

U.S. PATENT DOCUMENTS

| | | | |
|---|---|---|---|
| 1,232,282 | 7/1917 | Gossard . | |
| 2,250,807 | 7/1941 | Lunney . | |
| 2,705,799 | 4/1955 | Frischer | 450/130 X |
| 2,803,822 | 8/1957 | Doyle | 450/130 |
| 2,814,805 | 12/1957 | Blalt | 450/155 |
| 2,875,766 | 3/1959 | Lobbenberg | 450/124 |
| 2,893,397 | 7/1959 | Plehn | 450/122 X |
| 2,982,287 | 5/1961 | Paveza | 450/118 |
| 3,065,753 | 11/1962 | Fridolph | 450/124 |
| 3,142,302 | 7/1964 | Schonberg | 450/124 X |
| 3,437,092 | 4/1969 | Salisky | 450/123 |
| 3,526,229 | 9/1970 | Blair | 450/131 X |
| 4,538,615 | 9/1985 | Pundyk | 450/131 |
| 4,746,318 | 5/1988 | Moyer . | |
| 4,789,372 | 12/1988 | Wicks . | |
| 4,822,317 | 4/1989 | Wimmer . | |
| 4,836,824 | 6/1989 | Seering et al. . | |
| 5,205,815 | 4/1993 | Saunders | 450/150 X |

FOREIGN PATENT DOCUMENTS

| | | | |
|---|---|---|---|
| 2029655 | 1/1994 | Canada . | |
| 886594 | 1/1950 | France . | |
| 1229704 | 4/1971 | United Kingdom | 450/131 |

OTHER PUBLICATIONS

Mantle, M. J., Greenwood, R. M., Currey, H. L. F., (1977), *Backache in Pregnancy,* Rheum. and Rehab. 16:95–101.

Fast, A., Shapiro, D., Ducommun, E. J., Friedmann, L. W., Bouklas, T., Floman, Y., (1987), *Low–Back Pain in Pregnancy,* Spine 12: 368–371.

Berg, G., Hammar, M., Moller–Nielsen, J., Linden, U., Thorblad, J., (1988), *Low Back Pain During Pregnancy,* Obstet. and Gynec. 71:71–75.

Fast, A., Weiss, L., Ducommun. E. J., Medina, E., Butler, J. G., (1990), *Low–Back Pain in Pregnancy,* Spine 15: 28–30.

Ostgaard, H. C., Andersson, G. B. J., Karlsson, K., (1990), *Prevalence of Back Pain in Pregnancy,* Spine 16:549–552.

*Primary Examiner*—Jeanette E. Chapman

*Attorney, Agent, or Firm*—Oyen Wiggs Green & Mutala

[57] ABSTRACT

This invention pertains to an abdominal support for the extended abdomen of a person who is pregnant or has a large abdomen due to obesity. The abdominal support comprises: (a) girdle for fitting about at least a portion of the abdomen, hips and buttocks of a person, said girdle comprising: (i) a first web having therein elastic fibres, said web forming the girdle which fits about at least a portion of the abdomen, hips and the buttocks of the person; (ii) a second web over one side of the abdomen having therein a set of generally parallel elastic fibres inclined at an angle upwardly from the rear base of the left side of the abdomen of the person towards its front and attaching at a frontal midline; and (iii) a third web over the other side of the abdomen having therein a set of generally parallel elastic fibres inclined at an angle upwardly from the rear base of the right side of the abdomen of the person towards its front and attaching at a frontal midline; and (b) adjustable length suspenders detachably secured to the upper region of the girdle for fitting over the shoulders of the person and assisting in uplifting the weight of the abdominal area of the person and distributing the weight to the shoulders of person.

16 Claims, 6 Drawing Sheets

ABDOMINAL SUPPORT

FIELD OF THE INVENTION

This invention pertains to an abdominal support. More particularly, this invention relates to a support for the extended abdomen of a person who is pregnant or has a large abdomen due to obesity, both of which forward loading conditions cause the person to tilt his or her upper body rearwardly when walking and thereby place undue strain on the person's lower back.

BACKGROUND OF THE INVENTION

Low back pain is a relatively frequent complaint amongst pregnant women and has been related to factors such as altered posture, relaxation of ligamentous structures in the spine and pelvis, and direct pressure on the uterus. Obese persons, particularly those with large abdomens, also can suffer from back strain, mainly as a result of having to adopt a backward leaning posture to compensate for a disproportionate amount of forward weight.

An abdominal support designed by a physical therapist is available by special order from Trennaventions, Seattle, Washington, under the trademark BABYHUGGER (U.S. Pat. No. 4,789,372, granted Dec. 6, 1988). This support is merely a loosely fitting, flannel panty with a supportive upward lifting abdominal strap which extends over the shoulders. The arrangement does not appear to provide any relief of the forward cantilevered load created by the pregnancy, or minimize lower back aggravation and strain.

Canadian Patent No. 2,029,655, D. M. Ford, discloses a forerunner version of an abdominal support which has a triple layer construction which tends to be hot and confining, and has no abdominal pouch, posterior pocket, lateral oblique support or vertical front central support.

U.S. Pat. No. 2,250,807, Lunney, discloses an abdominal supporter which has a hip engaging back supporting jacket. The jacket is constructed of sheet fabric. The jacket is supported over the shoulders of the wearer by straps which are vertical at the front, but cross at the rear. The sides of the jacket can be expanded or contracted by drawstrings which are laced back and forth through eyelets. The suspender straps are permanently affixed to the rear and the sides of the abdominal support.

Lunney does not disclose an abdominal support area which has intersecting elasticizing fibres which align with the various layers of abdominal muscles of the wearer. Lunney does not disclose an abdominal pouch or a vertical front central support. Lunney does not disclose a hammock type abdominal support which has load carrying straps extending rearwardly under the arms from the abdominal area, intersecting at the shoulder blades and passing forwardly over each shoulder and either intersecting at the front chest or extending downwardly to the abdominal pouch. Lunney does not disclose a vertical pocket with a semi-rigid reinforcing plate at the lower back area of the abdominal support.

French Patent No. 886,594, Bonnereau, discloses an elasticized girdle which has an intersecting ribbon-web 5 woven across the front abdominal area of the girdle. The ribbon-webbing (rubans-sangles 5) is not elastic. Furthermore, Bonnereau does not disclose detachable suspenders, detachable panties, or reinforcing stays at the lower back area.

U.S. Pat. No. 1,232,282, Gossard, discloses an anatomical corset. The corset has angled bones or steels 15, 18 and 19, affixed to the abdominal, back and buttocks areas of the corset. These angled bones or steels are not elastic. Gossard also does not disclose detachable suspenders, nor detachable panties.

Several United States patents have been granted disclosing various designs of abdominal supports: U.S. Pat. No. 4,836,824, granted Jun. 6, 1989; U.S. Pat. No. 4,822,317, granted Apr. 18, 1989; U.S. Pat. No. 4,746,318, granted May 24, 1988.

Five papers are of interest in disclosing data relating to lower back and abdominal pain experienced by pregnant women and obese persons: Mantle, M. J., Greenwood, R. M., Currey H. L. F., (1977), *Backache in Pregnancy*, Rheum. and Rehab. 16:95–101; Fast, A., Shapiro, D., Ducommun, E. J., Friedmann, L. W., Bouklas, T., Floman, Y., (1987), *Low-Back Pain in Pregnancy*, Spine 12: 368–371; Berg, G., Hammar, M., Moller-Nielsen, J., Linden, U., Thorblad, J., (1988), *Low Back Pain During Pregnancy*, Obstet. and Gynec. 71:71–75; Fast, A., Weiss, L., Ducommun, E. J., Medina, E., Butler, J. G., (1990), *Low-Back Pain in Pregnancy*, Spine 15: 28–30; Ostgaard, H. C., Andersson, G. B. J., Karlsson, K., (1990), *Prevalence Of Back Pain in pregancy*, spine 16:549–552.

SUMMARY OF THE INVENTION

The invention is directed to an abdominal support for wearing by a person comprising: (a) a girdle for fitting about at least a portion of the abdomen, hips and buttocks of a person, said girdle comprising: (i) a first web having therein elastic fibres, said first web forming the main body of the girdle fitting about at least a portion of the abdomen, hips and the buttocks of the person; (ii) a second web having therein a set of generally parallel elastic fibres inclined at an angle downwardly from the upper region base of the left side of the abdomen of the person towards its front and attaching at a frontal midline, said second web fitting over or under a portion of the left side of the abdominal area of the first web; and (iii) a third web having therein a set of generally parallel elastic fibres inclined at an angle downwardly from the upper region of the right side of the abdomen of the person towards its front and attaching at a frontal midline, said third web fitting over or under a portion of the right side of the abdominal area of the first web; the two sets of elastic fibres of the second and third web corresponding generally with the respective direction of pull of the external oblique muscles of the person's abdomen, the second and third webs overlapping at the midline to form a vertical reinforced section over the midline of the abdomen of the person; and (b) adjustable length suspenders detachably secured to the upper frontal region of the girdle for fitting over the shoulders of the person and assisting in uplifting the weight of the abdominal area of the person and distributing the weight to the shoulders of person.

The girdle can include: (iv) a fourth web having a set of generally parallel vertical elastic fibres fitting over the overlapping area of the second and third webs and aligned to correspond generally with the vertical rectus abdominis muscles of the abdomen of the person.

The abdominal area of the first web, and the second and third webs can be constructed in the shape of a supportive pouch which conforms with the shape of a person with a distended abdomen. An elastic reinforcing band can be secured around the bottom of the girdle. The abdominal support can include a panty which can be secured to the bottom region of the girdle for fitting under the crotch of the person, said panty being releasably fastened to the frontal and lower rear regions of the girdle by releasable fasteners.

The first web of the girdle can be constructed of a fabric which can have multi-directional elastic fibres therein. The intersections of the second and third webs with the girdle at the left and right sides of the girdle can be substantially vertical and the lower ends of the two intersections can meet with one another across and below the abdominal area of the girdle.

The suspenders can be arranged in a crossed arrangement at the rear of the support or in a vertical pattern at the front of the support. The detachable suspenders can be crossed at the front of the support. The detachable suspenders can be crossed at the front of the support before fitting over the shoulders of the person.

A flexible stiffening support can be secured to the rear side of the girdle. The stiffening support can be formed to fit specifically the lumbar region of the person wearing the abdominal support. The rear side of the girdle means can have formed therein at least one pocket which can be adapted to receive a stiffening support to provide lower back support to the person.

The girdle and the suspenders can cooperate together to form a structure wherein the abdomen of the wearer can be supported by the girdle and the suspenders which cross at the back of the wearer, can extend over the shoulders of the wearer, and cross at the frontal region of the wearer, or can attach uncrossed in a vertical manner to the frontal region of the girdle. The suspenders can be releasably attached to the girdle by dome and socket snaps.

The abdominal support can include an elastic reinforcing band around the top of the girdle.

DRAWINGS

In drawings which illustrate specific embodiments of the invention but which should not be construed as restricting the spirit or scope of the invention in any way:

Figure 3A:
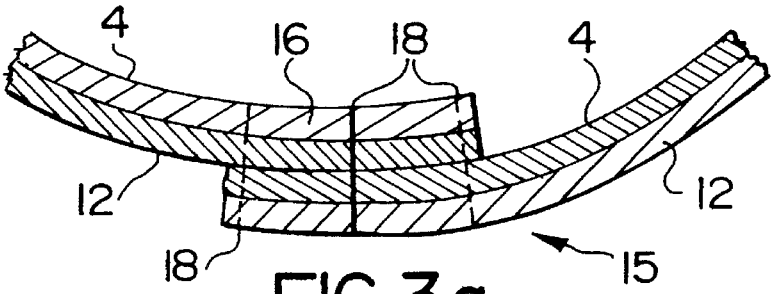

FIG. 3*a* illustrates a plan cross-section of the girdle at its frontal midline showing overlapping of girdle materials.

Figure 3B:
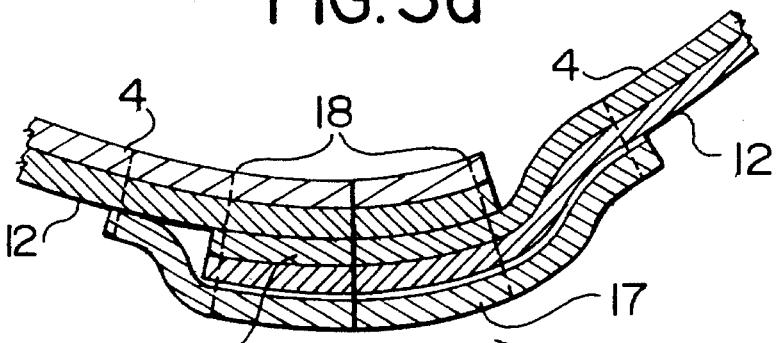

FIG. 3*b* illustrates a plan cross-section of the frontal part of the girdle with overlapping materials and an additional vertical support strap of elasticized material.

Figure 1:
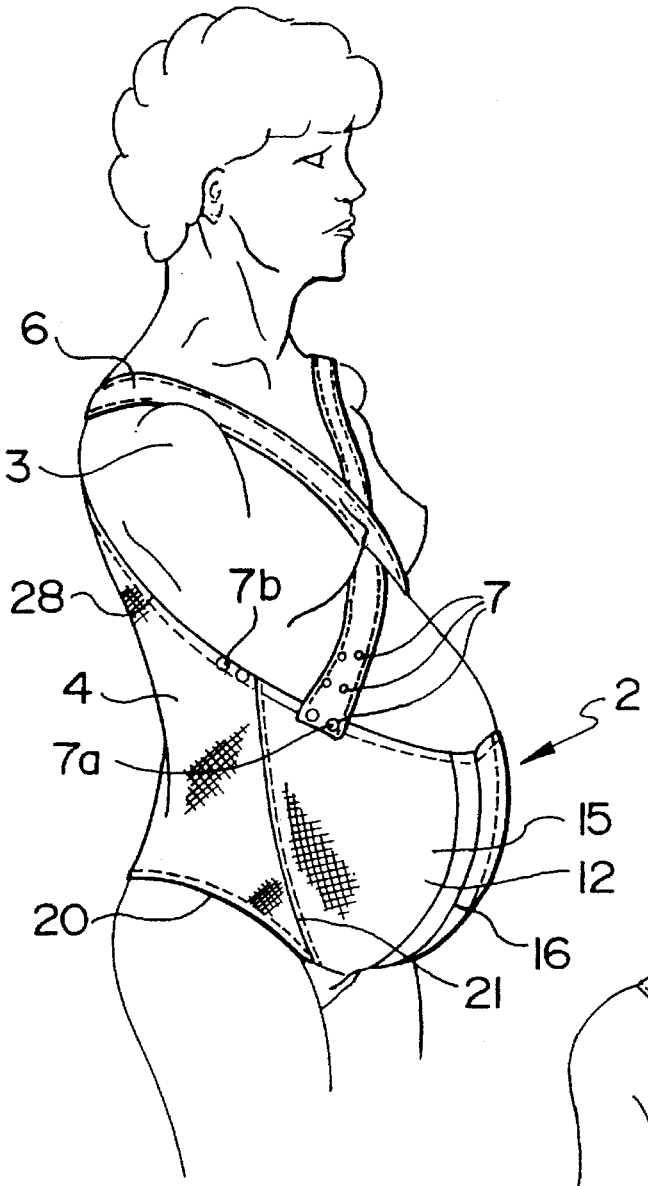
FIG. 1 illustrates a three-quarter side perspective view of a hammock style full abdomen support with crossed rear and front shoulder straps.
Figure 4:
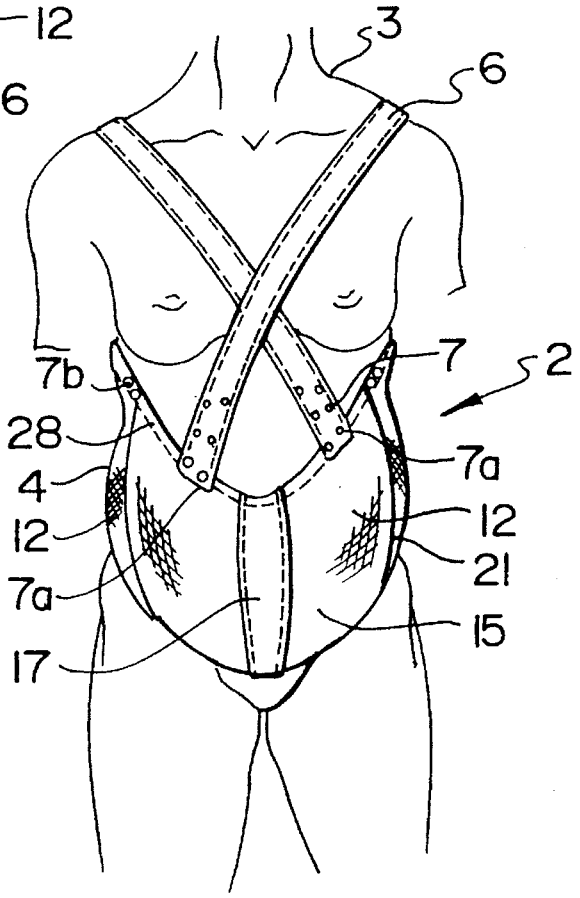

FIG. 4, which appears on the same sheet as FIG. 1, illustrates a front perspective view of the hammock style full abdomen support with crossed front shoulder straps.

Figure 5:
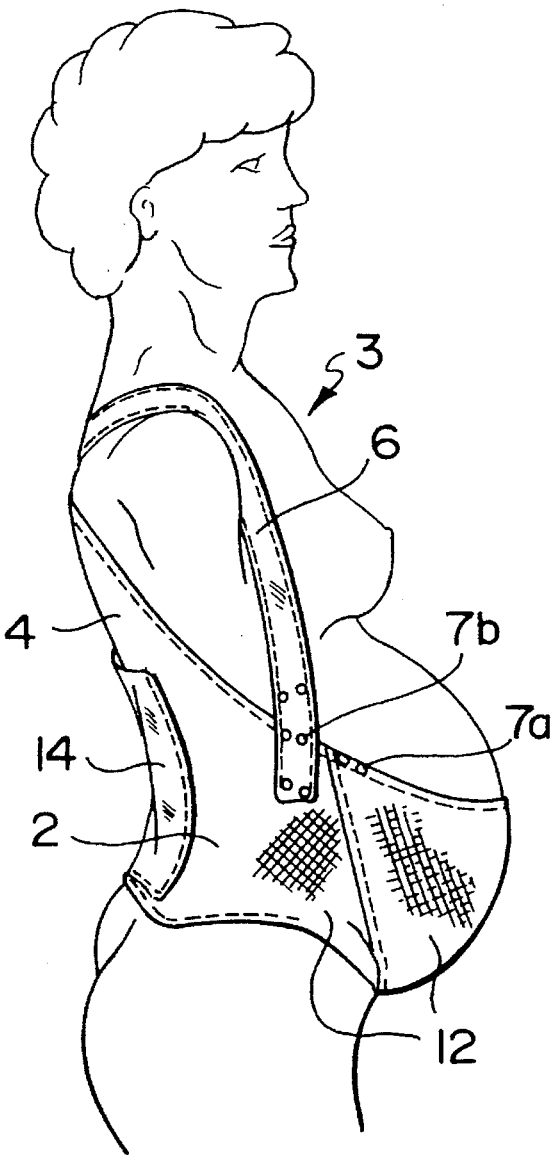

FIG. 5 illustrates a side perspective view of the hammock style full abdomen support with crossed back shoulder straps and vertical front shoulder straps.

Figure 2:
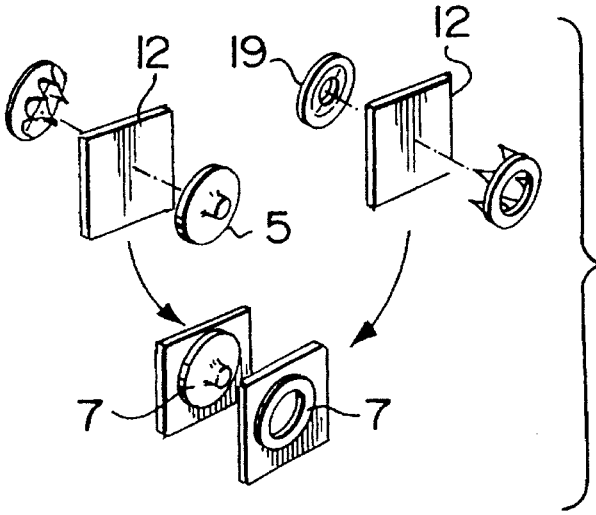
FIG. 2 illustrates in exploded view the components which make up the snap fasteners used to attach the straps and the body of the support together.
Figure 6:
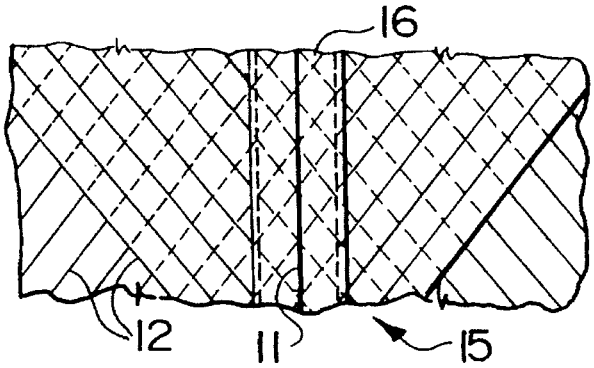

FIG. 6, which appears on the same sheet as FIGS. 2, 3*a* and 3*b*, illustrates a schematic view of the front overlapping layers of elasticized fabric arranged at angles to correspond with the vertical direction of the rectus abdominis muscles and the oblique angle of the lateral oblique muscles of the abdomen of a person.

Figure 7:
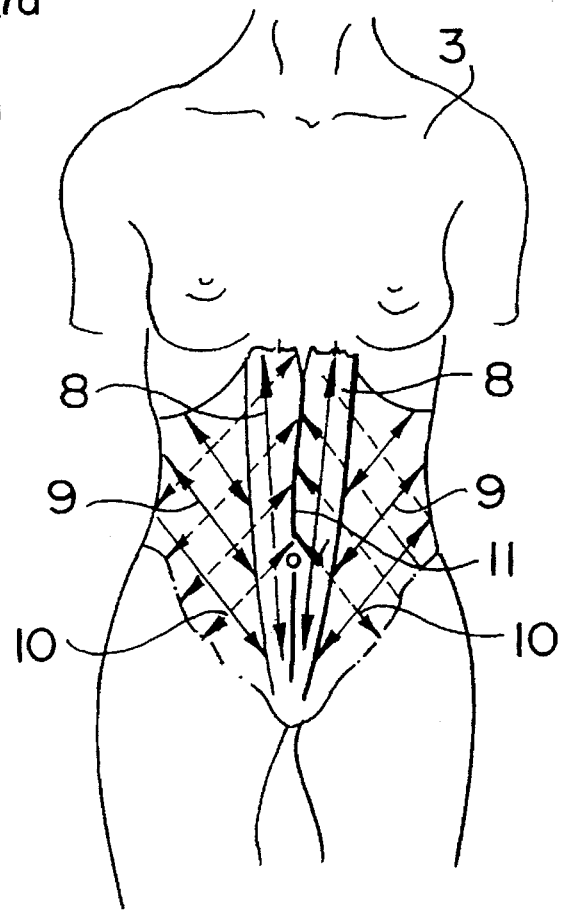

FIG. 7 illustrates a front diagrammatic partial section view of the direction of abdominal muscle fibres of a woman, exposing the vertical rectus abdominis muscles, the angled external oblique muscles, the angled internal oblique muscles and the midline frontal fascial division.

Figure 8:
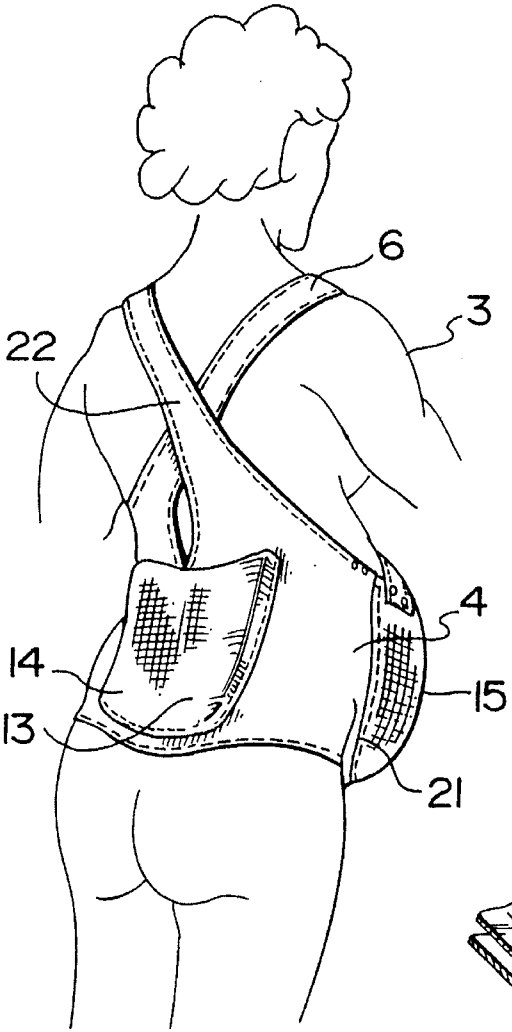

FIG. 8 illustrates a three-quarter rear perspective view of the hammock style full abdomen support with crossed rear and front suspenders and rear small back pocket with a semi-rigid insert.

Figure 9:
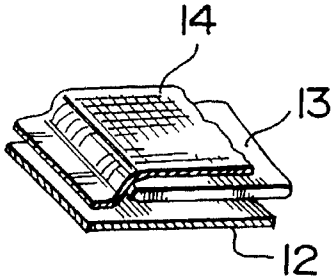

FIG. 9 illustrates a perspective view of a removable flexible stiffening plate situated within a portion of a small back pocket comprised of two layers of elasticized material and secured at the rear small back area of the girdle.

Figure 10:
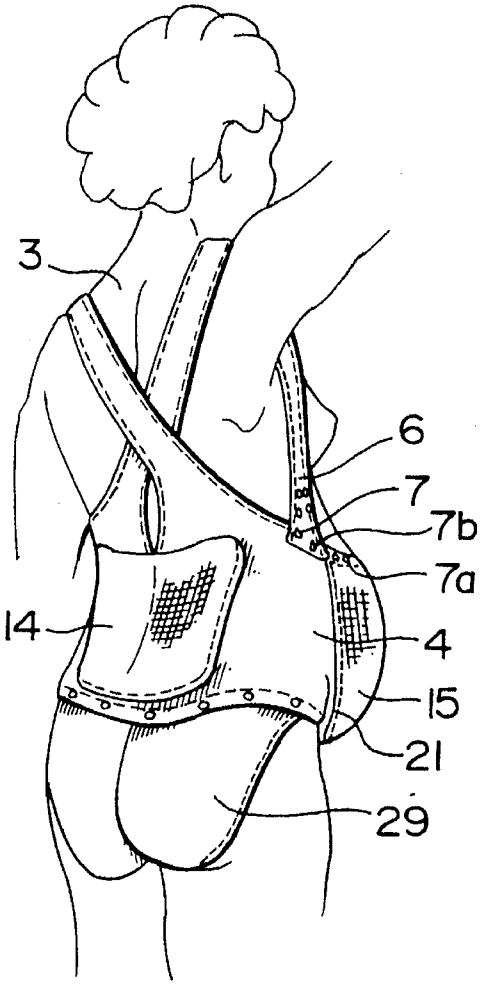

FIG. 10 illustrates a three-quarter rear perspective view of the hammock style full abdomen support with alternative crossed rear suspenders and vertical front suspenders and a rear small back pocket for a semi-rigid insert. Detachable panties secured to the bottom of the support are shown.

Figure 11:
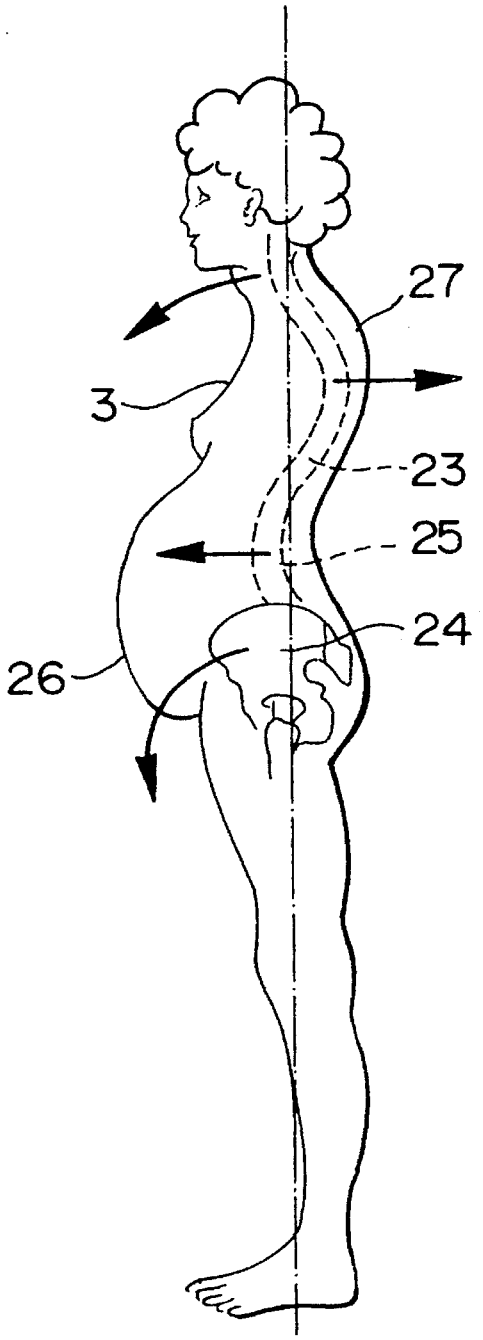

FIG. 11 illustrates a side view of a near full term pregnant woman with exaggerated spinal curve due to ventral gestation loading and posture compensation.

Figure 12:
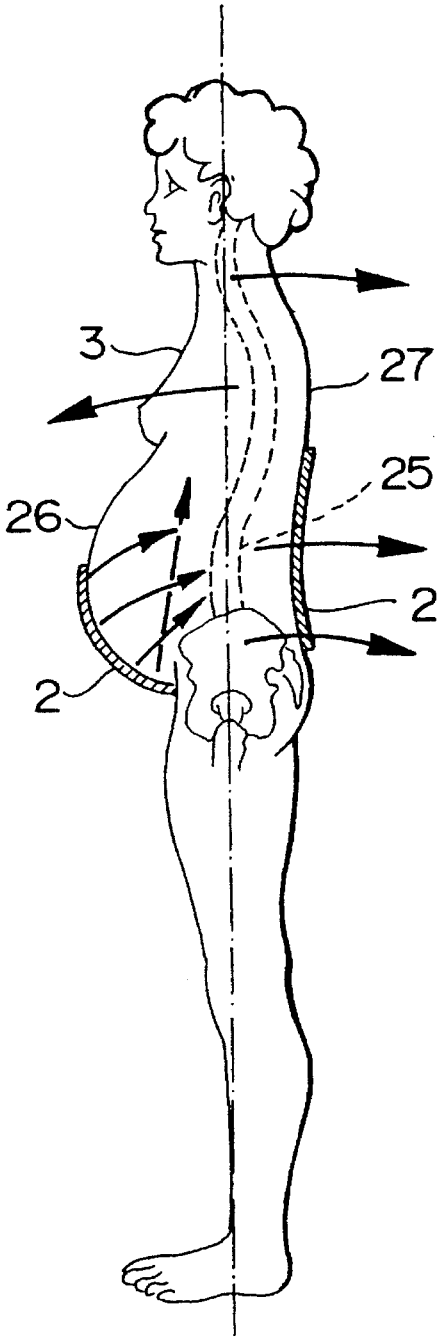

FIG. 12 illustrates a side view of a near full term pregnant woman wearing a hammock style full abdomen support with corrected spinal curves due to abdomen support.

Figure 13:
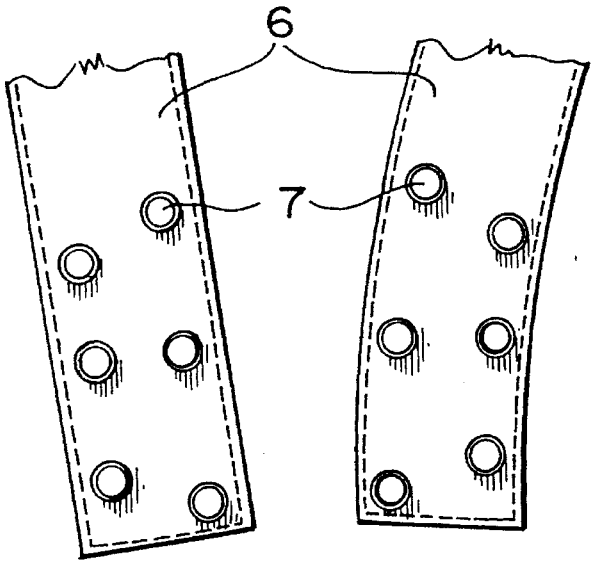

FIG. 13 illustrates an enlarged view of the angled snap arrangement on the end of a support strap.

Figure 14:
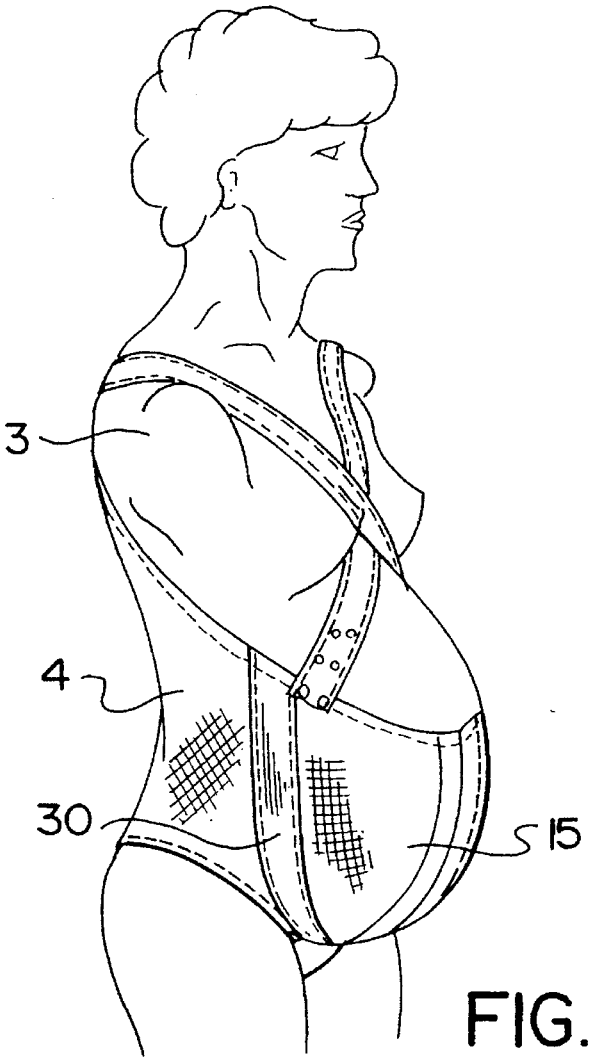

FIG. 14 illustrates a three quarter side perspective view of an alternative embodiment of the abdomen support with a reinforced support side band.

DETAILED DESCRIPTION OF SPECIFIC EMBODIMENTS OF THE INVENTION

Posture can be defined as a composite of the positions of all the joints of the body at any given moment. The human spine, supported below on the sacrum of the pelvis and balancing the cranium at its summit, consists of a multitude of individual blocks of bone (vertebrae) maintained in an upright posture by muscles, ligaments, and joints. Four moderate curvatures with a ventral (forward) or dorsal (backward) inclination exist in the normal spine, the lowermost ventral curve being called the lumbar lordosis.

Variations in the degree of curvature of the lumbar lordosis are based on intrinsic and extrinsic factors. Intrinsic factors include the shape of the vertebrae, ligaments, and intervening cartilaginous discs. Extrinsic factors include the centre of gravity, distribution of body weight, and the quality of muscle strength. Normal nerve tissues can become painful in everyday life by the application of prolonged stresses commonly appearing during static and postural loading conditions, such as prolonged sitting, standing or bending. There is abundant evidence to support the view that most back problems are mechanical in nature.

During childbearing years, the L1-S1 angle of lumbar lordosis (ie. the angle at which all five lumbar vertebrae sit in a curved manner on the first sacral vertebra) is greater in females than in men, possibly due to the small amounts of circulating Relaxin hormone. During pregnancy, however, such hormone is secreted in relatively large amounts and has the effect of "loosening" the pelvic and lumbar ligaments and joints.

The response of the lumbar spine to changes in pelvic posture appears to relate firstly to the location of the centre of gravity. The centre of gravity of the body is normally ventral to the promontory at the upper end (base) of the sacrum but becomes tipped forward with an associated increase in forward tilt of the pelvis, resulting in an exaggerated lumbar lordosis. In addition, a more lordotic posture accompanies the normal diurnal decline in height. In pregnancy, as in obese persons with pendulous abdomens, the centre of gravity is gradually displaced ventrally due to the forward shift in distribution of weight and uneven loading of the spine. In order to balance the additional weight, the upper body leans backward and the spine thus incurs an additional increase in lumbar lordosis. Mantle et al. found that 48 percent of 180pregnant females (mean age 26; 56 percent with no children) suffered from "troublesome to severe" backache beginning at the fifth month and increasing in incidence after the first pregnancy. Furthermore, in agreement with Glynn and Lloyd, they found that pain increased as the day passed, but was also common at night.

Of the muscles controlling the spine, there is a natural imbalance of strengths in that the dorsal erector spinae (back straighteners/extensors) are stronger than the abdominals (back benders/flexors) which can be comparatively weak. The abdominals are mostly transverse and obliquely oriented muscles, all capable of exerting considerable torque. These abdominals form a triple, circular layer of muscle around the torso and connect the vertebral column with the fascial coverings of the ventral Rectus Abdominis. Working together, the abdominals not only flex the trunk of the person forward and sideways, but cinch it in and cause an increase in the pressure within the abdomen (Intra-abdominal Pressure: IAP). An abnormally exaggerated lumbar lordosis is a common characteristic of a weakened anterior abdominal wall.

Intra-abdominal pressure (IAP) is a potent influence for reducing the loads applied to the spine and involves simultaneous contraction of the abdominal muscles, the diaphragm, and the muscles of the pelvic floor. It has been shown that IAP is most important in relieving the spine and part of the axial compression and shear loads by converting the trunk of the person into a more solid column and transmitting part of the load over a wider area. In obese or pregnant persons, a protruding and stretched abdominal wall may be physically incapable of producing the necessary mechanical efficiency and protective effect required of the abdominal muscles on the loaded lumbar spine.

The abdominal support of the invention is intended to be an important adjunct to proper back instruction and function, not a substitute. It is expected that the abdominal support will support and reinforce the function of the different layers of multidirectional abdominal muscles and provide relief from back strain, tissue stretch, and low back pain in situations of pregnancy and obesity. As economic stringencies increasingly limit what can be provided in health care, there is a need to offer inexpensive alternate preventative treatment.

Referring to FIGS. 1 and 4, which illustrate respectively side and front perspective views of the hammock style full abdominal support, the abdominal support 2 is constructed basically as an elasticized girdle 4, typically constructed of a fabric with embedded intersecting warp and weft elasticized fibres, which has crossed straps 6 which extend over the shoulders of the person 3 wearing the support 2. The straps 6 are releasably attached to the top frontal portion of the girdle 4 by snaps 7 (see FIG. 2), or other suitable fastening means, such as hook and pile fasteners (Velcro), which permit the straps to be detached from the top of the girdle 4 at the front region, and to be length adjusted. This enables the person to easily put on and take off the abdominal support 2. The straps 6 are equipped with sets of snaps 7 at three different levels to enable the length of the straps 6 to be adjusted to conform to the size and shape of the wearer 3. The snaps 7 of the straps 6 can also be attached by corresponding snaps at different positions, 7*a* or 7*b* (see FIG. 4), located on the top sides of the girdle 4. This adjustability in strap elevation as well as lateral strap position provides maximum flexibility and enables abdominal load impingement of the straps 6 on important nerves and blood vessels of the neck and axilla of the wearer 3 to be avoided.

The girdle 4 is constructed in the form of a hollow shell constructed of multi-directional elasticized woven fabric (for example, the multi-directional elasticized woven fabric available in the marketplace under the trade-mark LYCRA or SPANDEX) which fits over at least some of the waist, abdomen, hips and buttocks of the person 3. The girdle 4 is reinforced elastically at the frontal area in the form of a pouch 15. This is the high stress lower abdomen area that increases in size and weight in a pregnant woman.

In today's world, pregnant women and persons with extended abdomens are normally active and therefore require a support 2 that will provide relief from forward load discomfort. At the same time, the support 2 must be sufficiently flexible and light to permit reasonable activity and be relatively cool. The subject invention provides this extra localized strength without being bulky, restrictive or hot. This is accomplished by using a high strength nylon, woven elasticized fabric that is flexible and ventilated, for the girdle 4, and a similar fabric for the overlying forward pouch 15, which is an important feature of the invention.

As seen in FIG. 2, in exploded view scenario, the snaps 7, which are conventional, are formed of studs 5 compressed on one area of first fabric 12 and sockets 19 compressed on another area of second fabric to form the detachable snap and socket combination shown in the lower portion of FIG. 2. Typically, the studs 5 are attached to the straps 6, while the sockets 19 are attached to the top area of the girdle 4 (two lateral top locations 7*a* and 7*b* are illustrated in FIGS. 1 and 4).

As seen in FIGS. 1, 3*a*, 3*b*, 4 and 7, the frontal lower abdominal region of the girdle 4 is constructed and reinforced in the form of a layered pouch 15 from a plurality of overlying or intersecting webs of parallel elasticized fibres 12. These intersecting or overlying parallel group elasticized fibres 12 of the pouch 15, which can be formed in one fabric, or constructed in two or more overlapping layers, extend in individual parallel groups diagonally in three main directions to simulate respectively the angles of direction of the rectus abdominis 8, the external oblique 9 and the internal oblique 10 muscles of the abdomen of the person 3. (See explanation below in relation to FIG. 7 for further details.) Thus, the orientation of the webs of elasticized fibres 12 in three directions enables the frontal pouch area 15 of the girdle 4 to possess a sling action and imitate and reinforce the direction of contraction of the three muscle groups forming the abdomen of the pregnant or obese person (see FIG. 8), and thereby lift and distribute a good deal of the distended forward abdominal load which otherwise must be taken up fully by the abdominal muscles, or the person tilting the upper body rearward.

The pouch 15, and its design and construction, is an important and unique aspect of the invention. In previous designs of the abdominal support, it was found that the abdominal area was not ideally supported or lifted. The abdominal area of the girdle of the previous designs of support was found to tend to creep up gradually as the wearer moved around during the daily routine, including motions such as sitting, standing, bending, walking, twisting, and the like. Also, the abdominal area of the previous versions of the abdominal support was found to tend to spread the force on the abdominal area evenly in all directions (laterally, upwardly, downwardly, and at angles) and not upwardly. Accordingly, the prior designs did not provide sufficient lifting force on the distended abdomen in an upward vertical direction, which has been found to be an important consideration in relieving discomfort and providing flexibility and mobility to the support.

The unique design and construction of the pouch 15 over the abdominal area of the support 2 of the subject invention corrects these shortcomings. As seen in FIGS. 1 and 4 particularly, the circumference of the pouch 15 extends downwardly along each side of the distended abdomen and then under the distended abdomen of the wearer 3. This novel design of pouch 15 provides an elasticized expandable structure which encircles and lifts the distended abdomen in a homogenous manner. Further, to enhance the beneficial action, the central vertical area 16 of the pouch 15 is constructed by overlapping fabric 12 to provide a stretchable contoured vertical reinforced elasticized area which corresponds with the vertical rectus abdominis muscles 8 and midline 11 of the person 3 and provides reinforced vertical lift and support for those muscles 8. Figure illustrates a vertical reinforcing layer 17 sewn on top of the overlap 16 shown in FIG. 1.

In certain cases, if it is required, a reinforcing elasticized band 20 can be sewn around the bottom circumference of the girdle 4. This band 20 runs around the thighs and under the distended abdomen of the wearer 3 and discourages the girdle 4 from creeping upwards as the wearer 3 goes through his or her various motions of routine throughout the day. Also, to provide additional snugness and support, an optional elastic reinforcing band 28 can be sewn around the top circumference of the girdle 4.

As seen in FIGS. 1 and 4, the vertical inter-section 21 on each lateral side of the pouch 15 comprises the layers of pouch fabric 12 sewn onto or joined with the basic underlying elasticized fabric that forms the front, waist and rear portions of the girdle 4. If desired, these vertical lateral intersections 21 can be reinforced with reinforcing elasticized side bands 30 (see FIG. 14) to provide further uplift to these lateral areas of the girdle 4.

FIG. 3*a* illustrates in enlarged plan cross-section view the construction of the frontal midline portion of the pouch 15. Two overlying sections of elasticized fabric 12, arranged so that the intersecting parallel elastic fibres groups orient with the directions of the external and internal obliques 9 and 10 (see FIG. 7), are first sewn onto the respective underlying layers of the girdle 4, and are then sewn together in a manner such that in the mid-region, they overlap to form the vertical fabric overlap midsection 16 shown in FIG. 1. Preferably, for strength and even load distribution, the midsection 16 is sewn through with three parallel rows of strong stretchable elastic thread 18.

FIG. 3*b* illustrates in enlarged plan cross-section view the construction of an alternative design of the frontal midline 16 portion of the pouch 15. In this embodiment, a third layer 17 of fabric, which can be either elasticized or not elasticized, is sewn over the underlying overlapping vertical midline portions 16 of the girdle layer 4 and the overlying elasticized fibre fabric 12o The third reinforcing layer 17 is also preferably sewn together with at least three, and preferably five, rows of thread 18, especially the latter if the third layer 17 is wider than the overlap 16. FIG. 4 shows a front view of the vertical third reinforcing layer 17, overlying the overlapping and underlying midline 16 and the basic girdle layer 4.

The girdle 4, because of its multi-directional elasticized nature, and the unique abdomen cupping and load lifting action of the pouch 15, is highly supportive of the abdominal area, and develops a ring of supportive compression force around the spine of the wearer 3 and a circle of uplifting support around the distended bulbous abdomen of the wearer 3. At the same time, the elasticized material is soft against the skin, is light and flexible, conforms to the lower trunk area of the wearer 3, and is cool to the wearer 3. Pregnant women generally feel warmer than women who are not pregnant so it is important that the girdle 4 is cool to wear.

The subject invention is particularly useful in providing patients with relief when back strain and abdominal muscle pain is acute. Since the girdle 4 moulds to conform to the lower trunk area of the wearer 3, and the pouch 15 cups and lifts the abdomen of the wearer 3, it acts somewhat like a second skin and conforms with the wearer 3 as he or she moves. This permits the support to provide a comfortable fit in all positions, while at the same time lifting and transferring forward load forces evenly and minimizing lower back pain. This action enables the wearer 3 to participate and perform daily duties without appreciable difficulty or pain. The support 2 is lightweight and not bulky, so it can be worn under the clothing of the wearer, without presenting an overblown look.

FIG. 5 illustrates a side perspective view of the hammock full abdominal support 2 constructed with a network of multidirectional elasticized fibres 12, in which the front straps 6 are in a vertical position, and the straps 6 are detachable by means of snaps 7 and fastened to the rear sockets 7. Because of the hammock-like construction and the multiple snap 7 positions, the tension and position of the girdle 4 can be adjusted by means of adjusting the length of the front straps 6, and the location of attachment to the girdle 4, to suit the needs of the wearer 3 at all times from midterm pregnancy to full term pregnancy.

FIG. 6 illustrates a schematic view of the layers of elasticized fabric of the pouch 15 with intersecting sets of elasticized parallel fibres 12 arranged at angles to correspond respectively with the direction of pull of the layers of underlying abdominal muscles, namely, the external oblique muscles and the internal oblique muscles of a person (see FIG. 7). The construction of the fibres, and the directions thereof in the construction of the pouch 15, correspond with the respective directions of the rectus abdominal 8, the external obliques 9, and the internal obliques 10, as seen in FIG. 7. The midline 11 of the front abdomen is illustrated in FIG. 7. The contour of the pouch 15 cups and surrounds the spherical abdominal area, and with the midline 11, provides a lifting sling-like action to the abdominal area.

By arranging the warp direction of orientation of the respective elasticized fibres of the fabric 12 as shown, the specific directions of the various abdominal muscles 8, 9, 10 forming the abdominal area of the person are specifically supported. The warp fibres of the fabric provide more support than the weft fibres, which pass over and under the warp fibres. When the three basic abdominal muscle groups are unsupported, and the person has a distended abdomen, they become extended and weakened. The elasticized fibres of the abdominal support 2 with the unique pouch design 15 stretch, and make up for the reduced strength of the abdominal muscles, proportional to the degree of stretch.

FIG. 7 illustrates a cut-away front view of the abdominal muscle layers of a woman 3, exposing the rectus abdominis muscles 8, the external oblique muscles 9, the internal oblique muscles 10 and the midline frontal line of union 11. FIG. 7 illustrates, in particular, the respective spective angular orientations of the rectus abdominis 8, which serves as a support column and extends vertically, the superficial external oblique muscles 9 on each side, which extend downwardly at an angle from the back and side to the front of the person, and on each side the underlying deeper group of internal oblique muscles 10, which extend upwardly from the rear and side to the front of the person 3. These dual muscle groups 9 and 10 all connect with the vertical rectus abdominis muscles 8 located at the front abdominal region of the person by way of fibrous material (fascia). FIG. 7 also illustrates the vertical midline of the front abdomen 11, the line of union joining the left and right sides of the person. The various layers of elastic fibres of the support 2, extending in various predetermined directions, are intended to match these abdominal muscle layers.

As seen in FIGS. 8, 9 and 10, the rear "small of the back" portion of the girdle 4 is equipped with an elongated vertical pocket 14. This pocket 14 is adapted to receive and hold in place one or more semi-rigid inserts 13 which reinforce the rear small of the back area of the girdle 4, where back pain normally develops. The inserts 13 can be formed of lightweight spring-like metal or resilient semi-rigid thermoplastic. Interchangeable inserts of varying degrees of rigidity can be used to suit the specific needs of each wearer 3. Since the pocket 14 is normally formed of relatively stiff elasticized material, some extra support will be offered by the vertical pocket 14 even without the insert 13 in place.

The multi web-like layer of elasticized fibres 12, extending in various oblique directions, to form the pouch 15, together with the resilient insert 13 in the vertical back pocket 14, serve to fully lift and support the load of the forwardly extended abdomen of the wearer 3, and provide support to the lower back region of the wearer 3. The crossed shoulder straps 6 and their appropriate connecting points 7*a* and 7*b* to the girdle at the alternative snap 7 locations on the straps 6, further distribute the weight of the anterior load created by the extended abdomen to the shoulders and the entire thoracic and lumbar spine, rather than be localized in the sensitive area of the lower back by the forward arching of the lower spine.

In particular, FIG. 8 illustrates a three-quarter rear perspective view of the hammock type full abdomen support 4. The construction of the crossed rear suspenders 22, which cross over the shoulder blades of the wearer and provide an inward pulling action, is illustrated. Also, the lower back region of the support 4 which includes a sewn on pocket 14, is adapted to contain a semi-resilient insert plate 13 which provides vertical and lateral support for the lower back region of the wearer 3. This embodiment can include detachable garters (not shown) for suspending nylon stockings. Alternatively, the support 2 can be worn with pantyhose. Also, any of the embodiments disclosed and illustrated can have detachable panties 24, if required, as shown in FIG. 10.

FIG. 9 illustrates an enlarged perspective section view of a removable flexible stiffening plate 13 situated within a portion of a pocket 14 comprised of two layers of elasticized material 12 and 14. The pocket 14 is secured at the rear side of the girdle 4 as seen respectively in FIGS. 8 and 10.

FIG. 10 illustrates in three-quarter rear view perspective, an alternative embodiment of the hammock type full abdominal support 2. In this embodiment, vertical front suspenders 6 are utilized, rather than crossed front suspenders, as illustrated in FIGS. 1 and 4. The suspenders 6 in the vertical position are detachably attached by snaps 7 at the top forward side region of the girdle 4, denoted by a corresponding number of complementary snaps 7*a* on the rear top of the girdle 4 and pouch 15 and lateral locations on each side. If the wearer 3 prefers crossed front straps 6, then the snaps 7 can be attached to the forward sockets 7*a*. FIG. 10 also illustrates detachable panties 29 which can be fastened to the bottom of the girdle 4.

FIG. 11 illustrates a side view of a near to full term pregnant woman 3 (seven months) with exaggerated spinal curve 23 (shoulders back, waist forward) due to the unbalanced weight of ventral frontal gestation loading. As can be seen in FIG. 11, the posture of the pregnant woman 3 is very poor. The spine 23 (shown in dotted lines), due to the forward cantilevered weight of the distended abdomen 26, takes on an exaggerated unhealthy "S-shape". As a result, the pelvis 24 tilts forward and acutely bends the lower spinal region 25, while the spine 23 in the shoulder blade area 27 compensates and curves abnormally to the rear. Because of this exaggerated "S" posture, various nerves for the body extending from between the vertebrae and spinal disks of the spine 23 of the person are pinched, particularly in the lower back area 25, and the pregnant woman 3 is thereby vulnerable to back pain in the lower spinal area 25.

FIG. 12 illustrates a side partial cut away view of the same seven month pregnant woman 3 wearing an hammock style full abdominal support 2 (shown in two end sections only) according to the invention. The hammock style full abdominal support 2, and the spinal pouch 15 design, as can be seen in FIG. 12, lifts and distributes the weight of the distended abdomen 26, as shown by the upwardly and rightwardly curving arrows, and serves to enable the person to maintain a reasonably erect posture. Compared to FIG. 11, the shoulder blades 27 move forward (see second uppermost arrow), and the lower spine 25 moves rearward (see second lowermost arrow) to assume a more normal spinal configuration. This avoids undue "S" curvature of the spine, and particularly undue forward curvature of the lower spine 25, which leads to back pain.

FIG. 13 illustrates an enlarged view of the angled snap 7 arrangement on the end of a support strap 6. The multiple snaps 7 and the assorted locations on the straps 6, as illustrated in FIG. 13, and the alternative locations of sockets 7 and 7*b* on the top front and top side regions of the girdle 4, provide a large number of optional positions for attachment of the straps 6 to the girdle 4, and thus accommodate virtually all sizes of person, all stages of pregnancy, and all degrees of comfort. The pairs of snaps 7 are angled to accommodate angles of attachment of the straps 6 to the girdle 4.

FIG. 14 illustrates a three quarter perspective view of an alternative embodiment of the abdomen support with a reinforced side support band 30. The side support band 30, illustrated in FIG. 14, is optional and is used in cases where the wearer 3 wants extra reinforcement and support at the sides and underneath the pouch 15. The side band 30 extends down one side at the junction between the girdle 4 and pouch 15 on one side, underneath the extended abdominal area of the person 3, and up the other side of the support 2, at the junction between the girdle 4 and pouch 15 on the other side, to provide an extra degree of lifting action to the circumferential areas of the pouch.

While not illustrated in FIGS. 1 and 4, and some of the other drawings, each of the embodiments illustrated can include detachable garter snaps or fasteners that enable nylon stockings and the like to be releasably secured to the abdominal support 2, at the bottom area.

Example

A lightweight prototype of the abdominal support has been tested on a twenty-five year old woman, five foot five inches tall, 130 pounds, who was seven months pregnant with her second child at the time of initial wearing of the abdominal support prototype. The woman's first child was two years old. From her fifth month of pregnancy and on, the woman had been experiencing acute back and abdominal pain to the point that she could not do housework or go shopping for household supplies for more than about one hour at a time. She had to lie down at frequent intervals, often hourly, in order to relieve the severe back and abdominal pain for a time. After resting, she could then carry on again with her duties for a further hour or so. She could not pick up her two year old child because the lower back pain encountered in lifting the child was too great. The pregnant woman held down a job and the serious and debilitating situation did not improve, even though her work routine involved sitting all day.

When presented with the prototype, and having unsuccessfully tried other ways to relieve the pain, the pregnant woman was sceptical. However, from the first day she tried on the abdominal support, there was instant and unexpected relief from her pain. The effect of instant relief was amazing to her. She was, to her surprise, able to do housework and go shopping, even for the whole day, without requiring frequent rest periods. She could again without pain care for and pick up her two year old child. She could carry on with her job during weekdays without pain. It was virtually the same as if she were not pregnant. The abdominal support assisted in carrying and distributing the weight of her extended abdomen, improved her posture, and completely eliminated the acute abdominal and lower back pain she had been experiencing. The prototype abdominal support was cool, lightweight, and did not create any noticeable discomfort. She was able to wear the support all day under her clothing. The only initial difficulty that was discovered, which was minor, was that the prototype abdominal support tended to gradually creep up at the bottom, as the woman moved about. This problem was corrected by sewing an elastic band along the bottom on the circumference of the abdominal support to hold down the bottom of the support.

A further benefit of the support was that as the woman came closer to term, and her breasts became enlarged and sore, she was able to move the crisscross front snaps from frontal snap positions to alternative snap positions to the side, and adjust the lengths of the straps, thereby relieving compression forces on her breasts.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

I claim:

1. An abdominal support for wearing by a person and supporting weight of the abdomen of the person by transferring abdominal weight to the shoulders of the person comprising:

(a) an elastic girdle for fitting about and encircling at least a portion of the hips, lower back and buttocks of a person, and a lower region of the abdomen of the person, said girdle comprising:

(i) a first web having therein elastic fibres, said first web forming a main body of the girdle for fitting about at least a portion of the hips, lower back and the buttocks of the person, and a lower region of the abdomen of the person extending from an upper region and a lower region of a left side of the abdomen of the person, to thereby define a left lower abdominal area, to an upper region and a lower region of a right side of the abdomen of the person, to thereby define a right lower abdominal area, a junction point between the left lower abdominal area and the right lower abdominal area forming a vertical frontal midline, as viewed by the person;

(ii) a second web secured to the left lower abdominal area of the first web and having therein a set of generally parallel elastic fibres inclined at an angle downwardly from the upper region of the left side of the first web towards the front of the abdomen and attaching to the first web at the frontal midline, said second web fitting over or under a portion of the left lower abdominal area of the first web; and (iii) a third web secured to the right lower abdominal area of the first web and having therein a set of generally parallel elastic fibres inclined at an angle downwardly from the upper region of the right side of the first web towards the front of the abdomen and attaching to the first web at the frontal midline, said third web fitting over or under a portion of the right lower abdominal area of the first web;

the lower abdominal area of the first web, and the lower left and lower right abdominal areas of the second and third webs, in combination, forming a supportive pouch which conforms with the lower abdominal shape of a person with a distended abdomen, the two sets of parallel elastic fibres of the second and third web corresponding generally in direction with the respective direction of pull of external oblique muscles of a person's abdomen, the second and third webs overlapping at the vertical frontal midline to form a vertical reinforced section over the vertical frontal midline of the abdomen of the person; and (b) pair of elastic elongated suspenders with a proximal end and a distal end, the proximal end secured to and extending from an upper rear region of the first web, the pair of suspenders passing over respective left and right shoulders of the person, the pair of suspenders being detachably secured at their distal ends to an upper frontal region of the girdle, said suspenders uplifting the weight of the abdomen of the person and distributing the abdominal weight to the shoulders of the person;

(c) a fourth web having a set of generally parallel vertical elastic fibres fitting over the overlapping area of the second and third webs and aligned to correspond generally with vertical rectus abdomens muscles of the abdomen of the person.

2. An abdominal support as claimed in claim 1 wherein an elastic reinforcing band is secured around a bottom region of the girdle.

3. An abdominal support as claimed in claim 1 including a panty which is secured to a bottom region of the girdle for fitting under the crotch of the person, said panty being releasably fastened to frontal and lower rear regions of the girdle by releasable fasteners.

4. An abdominal support as claimed in claim 3 wherein the first web of the girdle is constructed of a fabric which has therein multi-directional elastic fibres.

5. An abdominal support as claimed in claim 1 wherein intersections of the second and third webs with the girdle at left and right sides upper and lower regions of the girdle are substantially vertical and lower ends of the two intersections meet with one another across and below the abdominal area of the girdle.

6. An abdominal support as claimed in claim 1 wherein the suspenders are arranged in a crossed arrangement at the rear of the support.

7. An abdominal support as claimed in claim 1 wherein the suspenders are arranged in a vertical pattern at the front of the support.

8. An abdominal support as claimed in claim 1 wherein a resilient stiffening support is secured to rear side of the girdle.

9. An abdominal support as claimed in claim 8 wherein a stiffening support is formed to fit specifically over a lumbar region of the person wearing the abdominal support.

10. An abdominal support as claimed in claim 1 wherein the detachable suspenders are crossed at the front of the support.

11. An abdominal support as claimed in claim 10 wherein the detachable suspenders are crossed at the front of the support before fitting over the shoulders of the person.

12. An abdominal support as claimed in claim 8 wherein the rear side of the girdle means has formed therein at least one pocket which is adapted to receive the stiffening support to provide lower back support to the person.

13. An abdominal support as claimed in claim 1 wherein the girdle and the suspenders cooperate together to form a structure wherein the abdomen of the wearer is supported by the girdle and the suspenders which cross at the back of the wearer, extend over the shoulders of the wearer, and cross at the frontal region of the wearer.

14. An abdominal support as claimed in claim 1 wherein the girdle and the suspenders cooperate to form a structure wherein the abdomen of the wearer is supported by the girdle and suspenders which cross at the back of the wearer, extend over the shoulders of the wearer, and attach uncrossed in a vertical manner to the frontal region of the girdle.

15. An abdominal support as claimed in claim 1 wherein the suspenders are releasably attached to the girdle by dome and socket straps.

16. An abdominal support as claimed in claim 1 including an elastic reinforcing band around a top region of the girdle.

* * * * *